US005230291A

United States Patent [19]

Juvik-Woods

[11] Patent Number: 5,230,291

[45] Date of Patent: Jul. 27, 1993

[54] INTEGRATED TWO-WAY PAPER CARGO PALLET

[75] Inventor: Harry C. Juvik-Woods, San Rafael, Calif.

[73] Assignee: Damage Prevention Products, Inc., Benicia, Calif.

[21] Appl. No.: 904,990

[22] Filed: Jun. 26, 1992

Related U.S. Application Data

[63] Continuation-in-part of Ser. No. 635,195, filed as PCT/US91/09545, Dec. 26, 1991, abandoned.

[51] Int. Cl.[5] ..... B65D 19/00

[52] U.S. Cl. ..... 108/51.3

[58] Field of Search ..... 108/51.3, 56.3, 51.1

[56] References Cited

U.S. PATENT DOCUMENTS

| | | | |
|---|---|---|---|
| 2,432,295 | 12/1947 | Donahue | 108/51.3 X |
| 2,501,506 | 3/1950 | George | 108/51.3 |
| 2,503,240 | 4/1950 | Cahners | 108/51.3 |
| 3,464,371 | 9/1969 | Gifford | 108/51.3 |
| 3,661,099 | 5/1972 | Shelor | 108/51.3 X |
| 3,709,161 | 1/1973 | Kauffman | 108/51.3 |
| 3,982,057 | 9/1976 | Briggs et al. | 108/51.3 X |
| 5,129,329 | 7/1992 | Clasen | 108/51.3 |

FOREIGN PATENT DOCUMENTS

| | | | |
|---|---|---|---|
| 415507 | 3/1991 | European Pat. Off. | 108/51.3 |
| 1131148 | 6/1962 | Fed. Rep. of Germany | 108/51.3 |
| 3922635 | 1/1991 | Fed. Rep. of Germany | 108/51.3 |
| 558741 | 2/1975 | Switzerland | 108/51.3 |

*Primary Examiner*—Jose V. Chen

*Attorney, Agent, or Firm*—E. Thomas Wheelock

[57] ABSTRACT

This is a pallet as might be used to support cargo during that cargo's transportation or storage. The pallet is constructed of paper. The pallet design involves a central platform or deck constructed of a honeycomb filler bounded on the bottom surfaces by a corrugated sheet. The upper surface of the central platform may be covered with a corrugated sheet or heavy paper stock. Additionally, the upper and/or lower sheets may be folded over the edges of the honeycomb core and fastened to the other side. Runners or legs are included to support the central platform.

16 Claims, 8 Drawing Sheets

INTEGRATED TWO-WAY PAPER CARGO PALLET

RELATED APPLICATIONS

This is a continuation-in-part of U.S. Ser. No. 07/635,195, filed Dec. 26, 1990, entitled "PALLET DESIGN USING PAPER MATERIALS" now abandoned, and PCT/US91/09545, filed Dec. 26, 1991, entitled "PAPER CARGO PALLET", the entirety of which are incorporated by reference.

FIELD OF THE INVENTION

This invention is a pallet as might be used to support cargo during that cargo's transportation or storage. The pallet is constructed of paper. The pallet design involves a central platform or deck constructed of a honeycomb filler bounded on the bottom surfaces by a corrugated sheet. The upper surface of the central platform may be covered with a corrugated sheet or heavy paper stock. Additionally, the upper and/or lower sheets may be folded over the edges of the honeycomb core and fastened to the other side. Runners or legs are included to support the central platform.

BACKGROUND OF THE INVENTION

A pallet is a portable, horizontal, rigid, platform used as a base for assembling, storing, stacking, handling goods as a unit load. Conventional pallets are typically constructed of wood and are made by stapling or nailing a number of boards (known as "deckboards") at their ends to a number of continuous solid boards (known as "stringers"). The upper set and lower set (where used) of deckboards thereby form an open area defined by the thickness of the stringers. This opening is used to accommodate a fork lift or hand truck. In this way the pallet may be moved from place to place by lifting the pallet and its load off the floor.

The vast majority of all pallets used in the U.S. are constructed of wood, but wood pallets have many disadvantages. Labor and material costs for wooden pallets have increased faster than inflation. Because of their expense, the pallets are often reused or returned to their place of origin. The cost of returning empty pallets to their owners is obviously high. Additionally, The average weight of a wooden pallet is about forty pounds. Since shipping costs are usually tied to the weight of the goods shipped, the cost of shipping is increased by the weight of the pallet. Indeed, pallets are sufficiently heavy that smaller warehouse workers are able manually to move the pallets only with some difficulty. Wooden pallets are often damaged during use and, because of the pallet cost, must be repaired if possible or disposed of. Depending upon the industry involved, pallets may be used between two and four times before they are disposed of. Disposal of any solid materials including broken pallets is an increasingly difficult and costly problem.

My invention is a pallet constructed of paper involving a central platform or deck constructed of a honeycomb filler bounded on the bottom surface by a continuous corrugated sheet which covers the supporting legs or runners so to form a continuous cover over the entire bottom surface. The upper surface of the central platform may be covered with a corrugated sheet or heavy paper stock. Additionally, the upper and/or lower sheets may be folded over the edges of the honeycomb core and fastened to the other side. Runners or legs are included to support the central platform. In addition to the inherent strength and low cost of my pallet, by careful selection of construction materials, my design may be completely recycled as paper without separation into constituent parts.

There are a number of pallet designs which are made mostly of paper.

For instance, U.S. Pat. No. 3,661,099, to Shelor, shows a paper shipping pallet having a deck having a core section made of small strips cut from single, double, or triple wall corrugated paper board sheet stock glued face to face. Sheets of corrugated are glued to the longitudinal edges of the composite core. The core and facing sheets are desirably of a specific size of corrugated sheets, i.e., having a size "A" flute or better. The legs of the pallet appear to be wooden blocks.

U.S. Pat. No. 3,650,459, to Tucker, shows a paper pallet design involving a folded corrugate sheet as the cargo support area. That cargo deck is provided with a number of pallet feet (which operate as spacer blocks within the cargo deck) made of molded plastic material such as polystyrene. The use of a honeycomb core within the cargo support area is not disclosed.

U.S. Pat. No. 3,952,672, to Gordon et al, shows a disposable pallet made of a single folded corrugated sheet. The use of a honeycomb core on the cargo support area is not disclosed.

U.S. Pat. Nos. 4,867,074 and 5,001,991, to Smith, each show a pallet design in which the cargo deck is made up of a large number of girders folded from corrugated sheet and assembled with a series of cross girders. The use of a honeycomb core in the cargo support area is not disclosed.

U.S. Pat. No. 4,790,249, to Webb, shows a pallet design in which the cargo deck is made up of facing sheets separated by a number of blocks having a specific design. The block design involves a cellulosic material glued together by a bonding material (such as ureaformaldehyde) all extruded into the shape of a box beam. The boxes are positioned so to protect the deck from the tines on a fork lift.

Netherlands Patent Application 83-00024 shows an interesting design for a paper pallet. The cargo support deck appears to be constructed of a number of loops of paper glued together at a number of sites within the deck and also glued to a periphery forming the edge of the deck. Neither the use of a honeycomb core nor the use of corrugated sheet in the cargo deck support area is disclosed.

There are few disclosures showing the use of honeycomb materials in the core of the cargo support deck.

One such disclosure is Published U.K. Patent Application 2,213,462-A to Green et al. This published application shows a paper pallet design in which the cargo deck is made up of two face sheets of, e.g., corrugated cardboard and having a an open structure such as a paper or card honeycomb between them. It is said that the deck may be raised from the floor using feet of similar construction. The deck core is made to be penetrable by the tines of a fork lift. The disclosure is silent on the use of a corrugated sheet folded over the edge of the central core and fastened to the opposite side.

U.S. Pat. No. 4,319,530, to Moog, discloses a pallet, said to be disposable, having a cargo supporting deck area made up of a central core of a honeycomb made of laminated corrugate. The core is faced with one or more corrugated sheets glued to the core. The facing on the cargo support surface of the central core may be made up of multiple layers of corrugated sheets. The disclosure is silent on the use of a corrugated sheet folded over the edge of the central core and fastened to the opposite side nor, obviously, is any benefit accorded such a folded sheet.

None of these disclosures show a pallet constructed of paper involving a central platform or deck constructed of a honeycomb filler bounded on the top and bottom surfaces by corrugated sheets nor do these disclosures show the feature of increased physical stability due to the integration of the lower surface as support for the central platform.

SUMMARY OF THE INVENTION

In general, this invention is a pallet as might be used to support cargo during that cargo's transportation or storage. The pallet is constructed of paper. The pallet design involves a central platform constructed of a honeycomb filler. The upper surface of the central platform may be bounded on the upper surface by corrugate or paper or other suitable covering. The lower surface of the central platform is bounded by longitudinal runners or legs, particularly those utilizing honeycomb or corrugate cores and corrugate skins and adapted so that the skins overlap up on to the edges of the central platform. Although the invention may be made of a variety of materials, I prefer to construct the pallet from materials which may be readily recycled using commercially available technology. For instance, the various sheet material is desirably from kraft paper or other similar paper stock. Of course, depending upon the service into which the pallet is placed, other materials may be selected, e.g., MYLAR, polyethylene, polypropylene (clear or fibrous paper product), or the like is acceptable. Some thermosetting polymeric materials are not currently widely recyclable and may not be the best of choices for the pallet from that viewpoint. However even with nonrecyclable materials the improvements of the pallet design will be apparent. Choice of materials and methods to join together the various components of the pallet may also be made on the basis of recyclability. For instance, most water-based glues, e.g., hide glue, mucilage, etc. are glues compatible with the kraft paper recycling processes. Heat sealing thermoplastic materials such as polypropylene is an expedient using no adhesive.

Figure 1A:
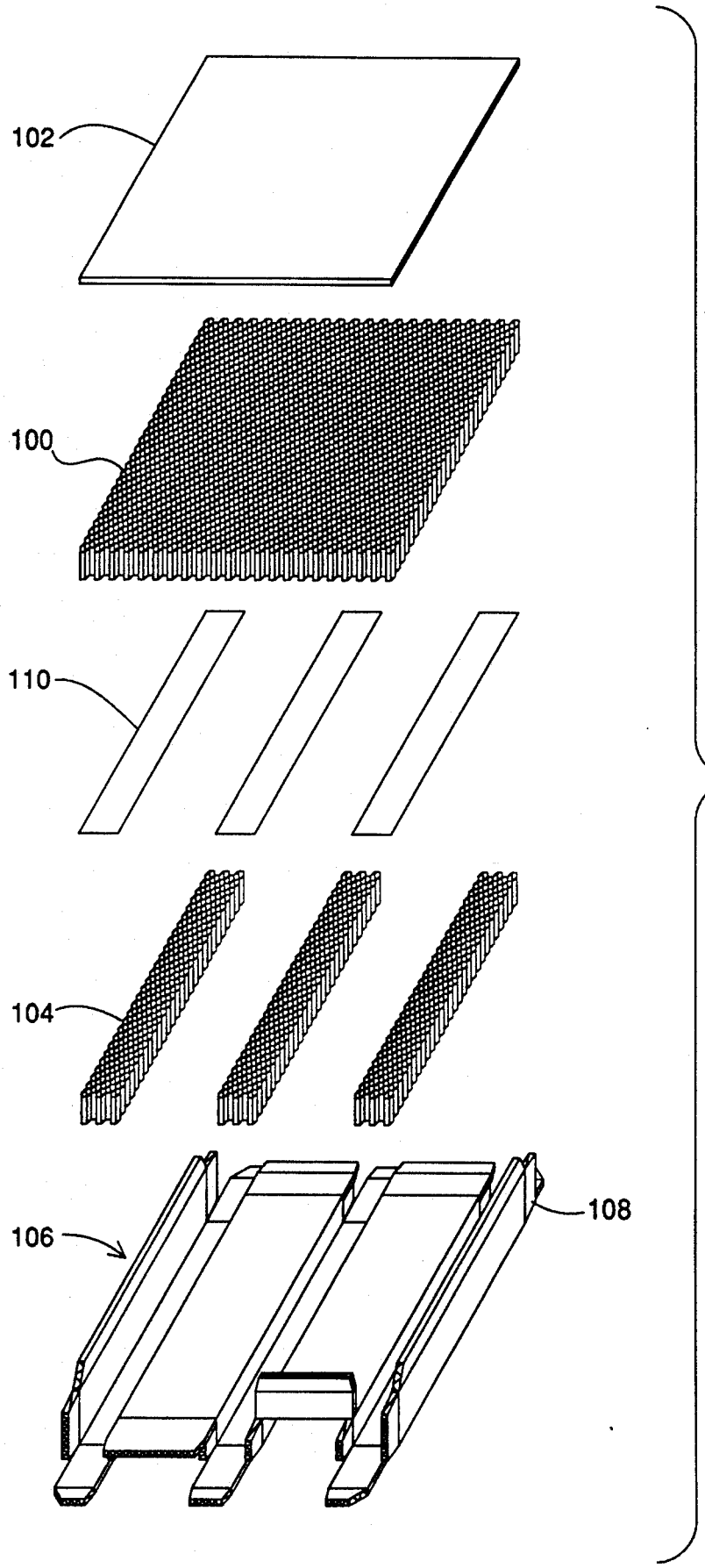
FIG. 1A is an exploded drawing of the components of one of the basic configuration of the invention using runners to support the cargo deck.

FIG. 1A is an exploded diagram showing the components of one basic configuration of the invention. In this configuration, the central core (100) comprises an expanded honeycomb material. Joined to this core on the upper face of the core is a facing sheet (102). The facing sheet may be of a corrugate or a sheet of a suitable material such as paper. This variation of the pallet uses a lower corrugate sheet which is integrated with the runners supporting the core (100) to enhance the overall strength of the pallet. The runners and the lower deck facing are made of a set of runner cores (104) of expanded honeycomb or multilaminate corrugate and a lower folded corrugate sheet (106). The runners are separated from each other on the lower face of the core and cover at least a portion of that lower face. They run from one edge of the deck transversely to the opposite edge. The lower corrugated folded sheet (106) adheres to and encloses the runner core blocks (104). It also has tabs (108) which may be folded over and allow it to adhere to the cargo (or upper) surface of the upper face (102).

It may be desirable to include a glue sheet (110) between runner core blocks (110) and core deck (100). Although it is not required, the glue sheet may provide an enhanced surface to allow both better adhesive junctions between the two adjacent honeycomb blocks and closure of the cells in the honeycombs. If the method for joining the various sheets to the core is properly carried out, the cells within the core are isolated from each other. The core strength is enhanced by the formation of these closed cells and imparts an amount of springiness and shock absorbing capabilities to the core.

The runners obviously cannot be separated from the deck without the virtually complete destruction of the pallet.

If the upper facing sheet (102) is a corrugate sheet, the flutes in the respective corrugated sheets (102, 106) should be positioned such that the flutes in sheet (102) are not parallel to the flutes in sheet (106). The angle between the respective flutes may between about 30° and 90° although for a very practical pallet from the vantage of strength, versatility, and ease of construction, an included angle between the flutes of about 90° is desirable.

Figure 1B:
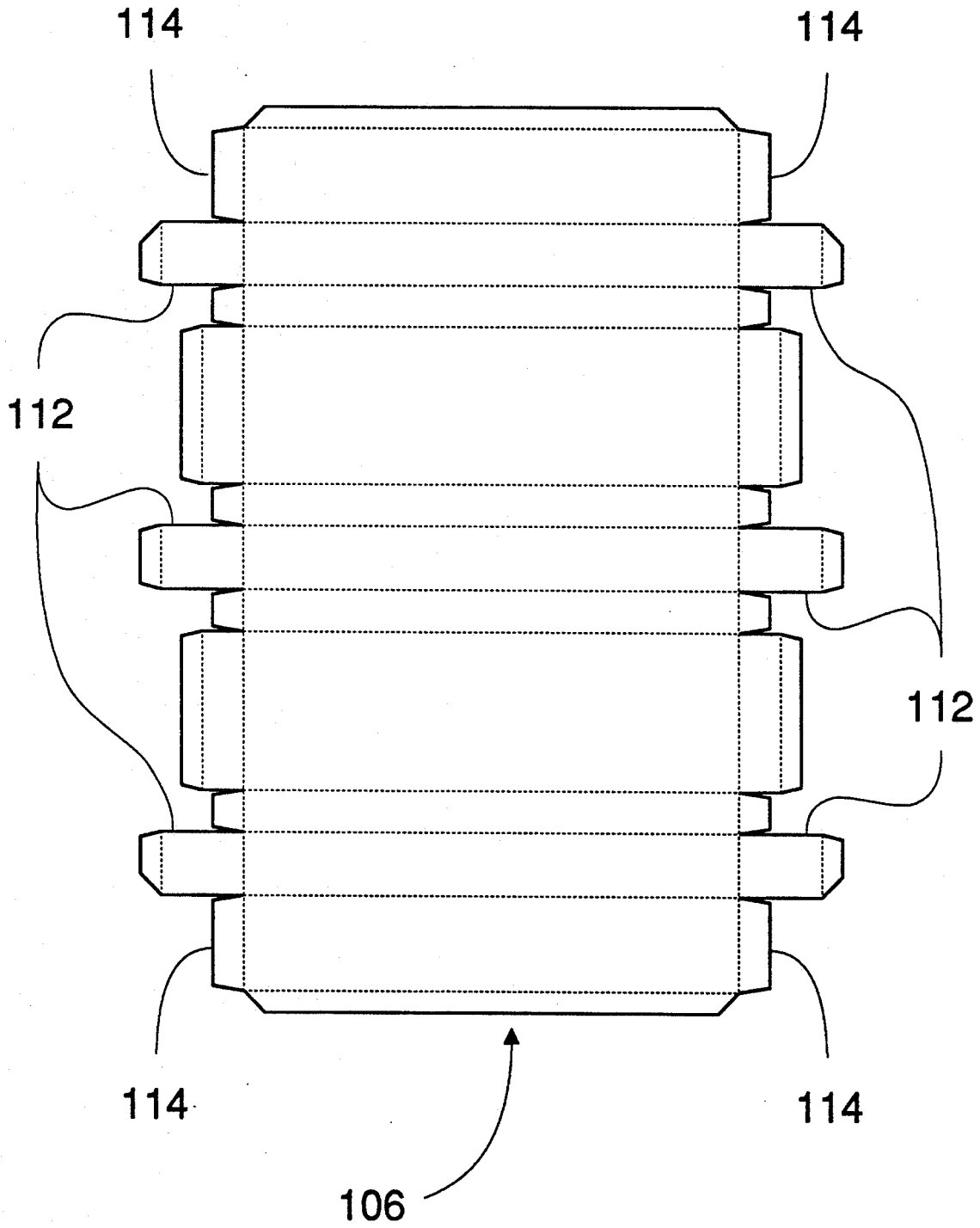
FIG. 1B shows a plan diagram of the lower sheet used in the FIG. 1A configuration.

FIG. 1B shows a plan view of the bottom facing sheet (106). The long tabs (112) extending from the long side of the sheet (106) fold over the ends of the runner blocks (104) and the edge of the central core (100) as is shown in FIG. 1A. Similarly, the broad tabs (114) fold over the long side of the runner blocks (104) and the edge of the central core (100) as is shown in FIG. 1A. The smaller tabs shown on the FIG. 1B lower facing sheet (106) are all folded over the adjacent edge when folded as depicted in FIG. 1A. The tabs are all glued to the sheet to which they are attached.

Figure 2A:
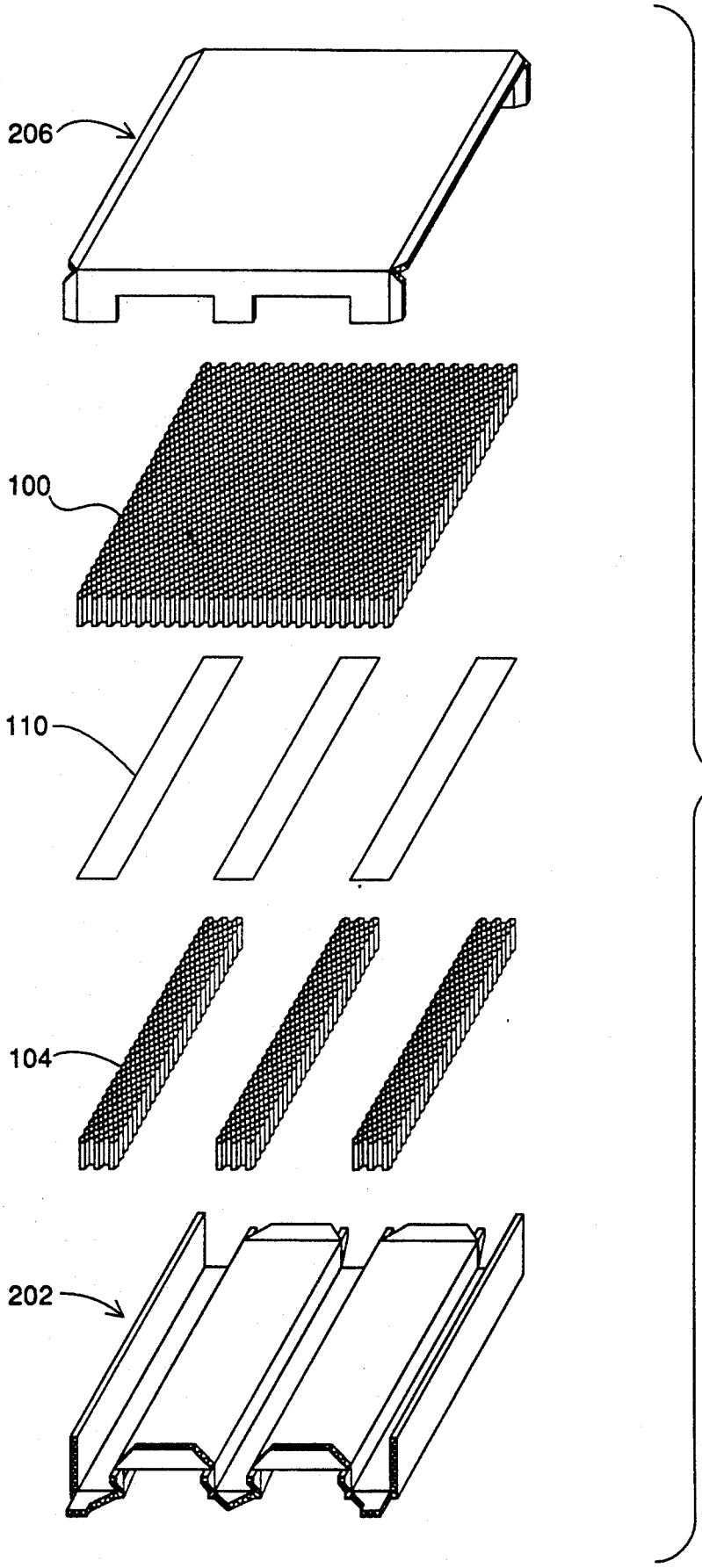
FIG. 2A is an exploded drawing of the components of another variation of the invention using runners to support the cargo deck.
Figure 2B:
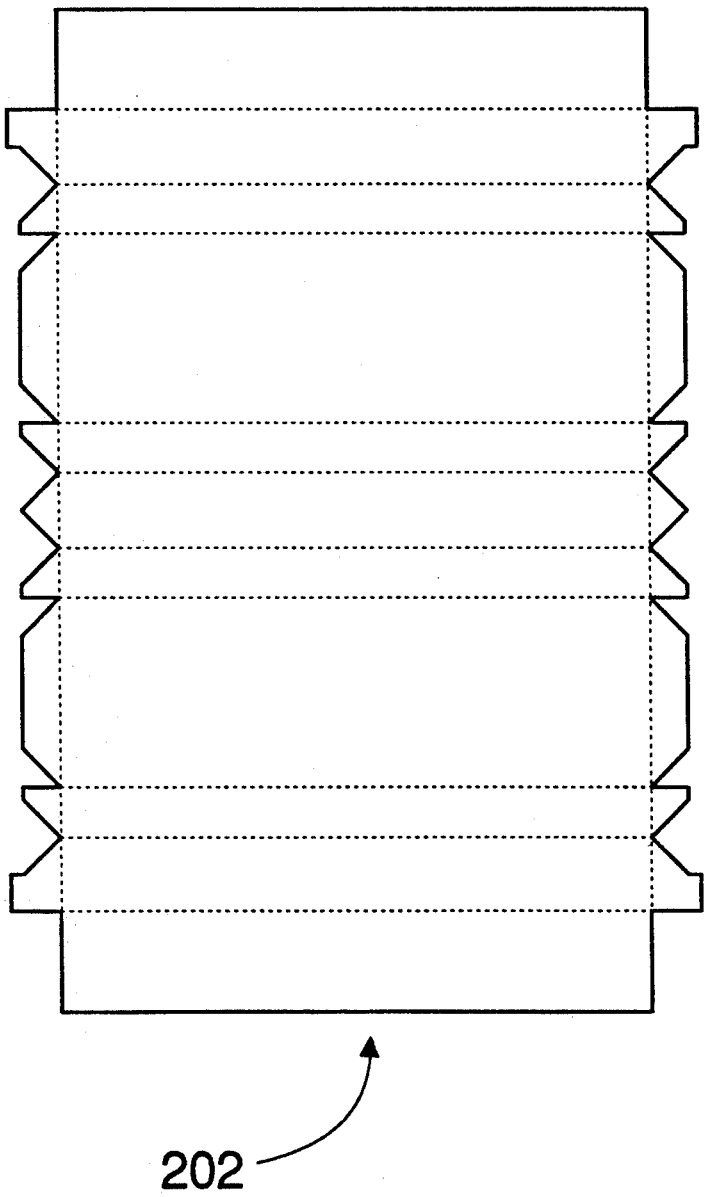
FIGS. 2B and 2C show plan diagrams of the upper and lower sheets used in the FIG. 2A configuration.
Figure 2C:
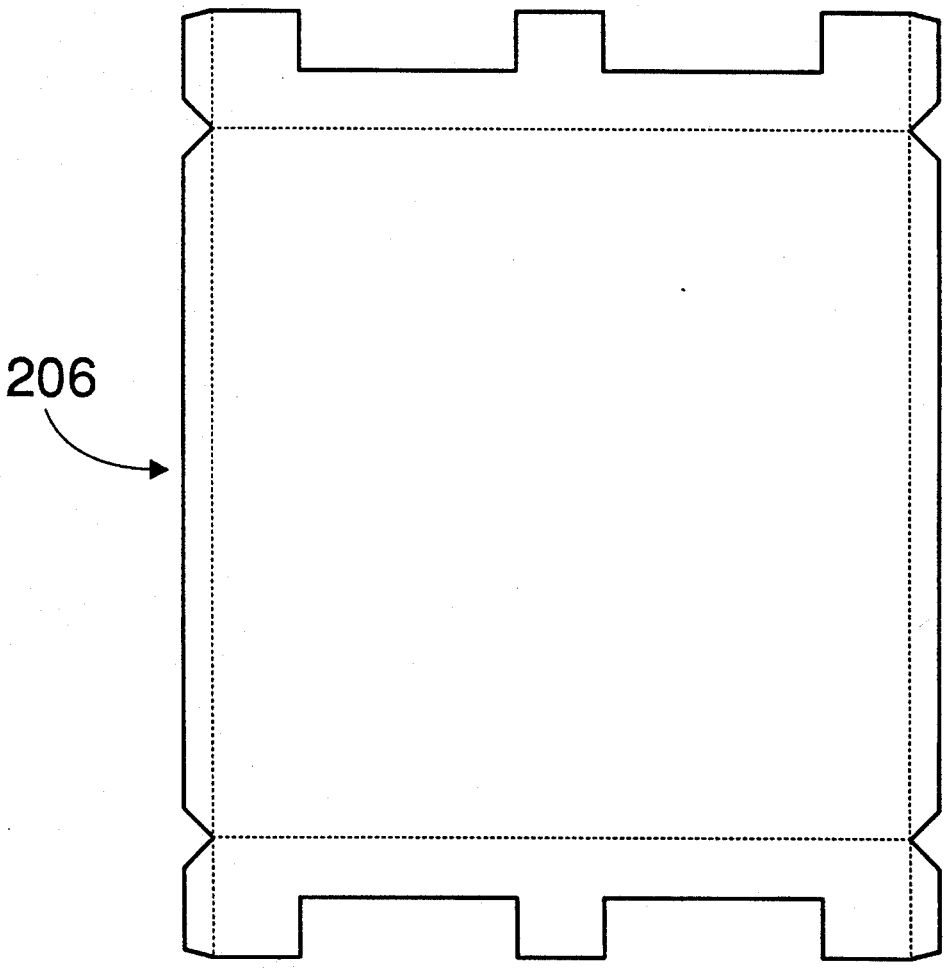

FIG. 2A shows an exploded drawing of a variation of the invention. Similar to the combination shown in FIG. 1A, the variation in FIG. 2A involves a honeycomb core (100). The lower sheet (202) is preferably a corrugate sheetstock as was (106) in FIG. 1A. The lower facing sheet (202) is also shown, in plan, in FIG. 2B. It should be apparent that this sheet is easier to cut from stock sheet material than is the lower sheet (106) shown both in FIGS. 1A and 1B. However, it is less suitable for use with the upper facing sheets (204) which are solely paper in that the flap of the paper folded over the ends of the runner blocks (104) and central core (100) does not lend substantial strength to the assemblage. However, the FIG. 1B variation is quite sturdy with a corrugate upper facing sheet (204). Upper facing sheet (204) is shown, in plan view, in FIG. 2C. In this variation, the upper surface of the pallet is smooth, i.e., it has no seams on the upper surface to catch cargo and tear the pallet.

The upper sheet (206) is folded over the edge of the honeycomb core (100) and overlapped onto and fastened to the lower sheet (202). The flutes in the upper sheet (202) are preferably not parallel to the corrugated flutes in the lower sheet (202).

Figure 3A:
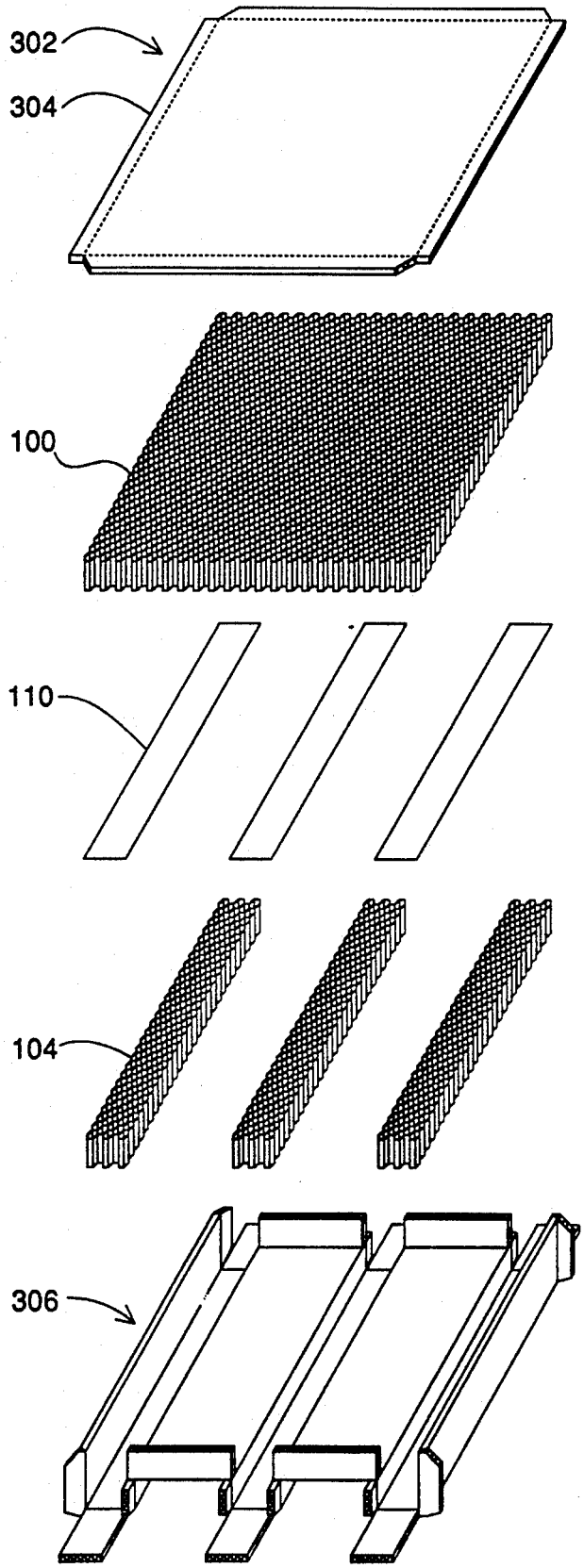
FIG. 3A is an exploded drawing of the components of a variation of the FIG. 1A pallet.
Figure 3B:
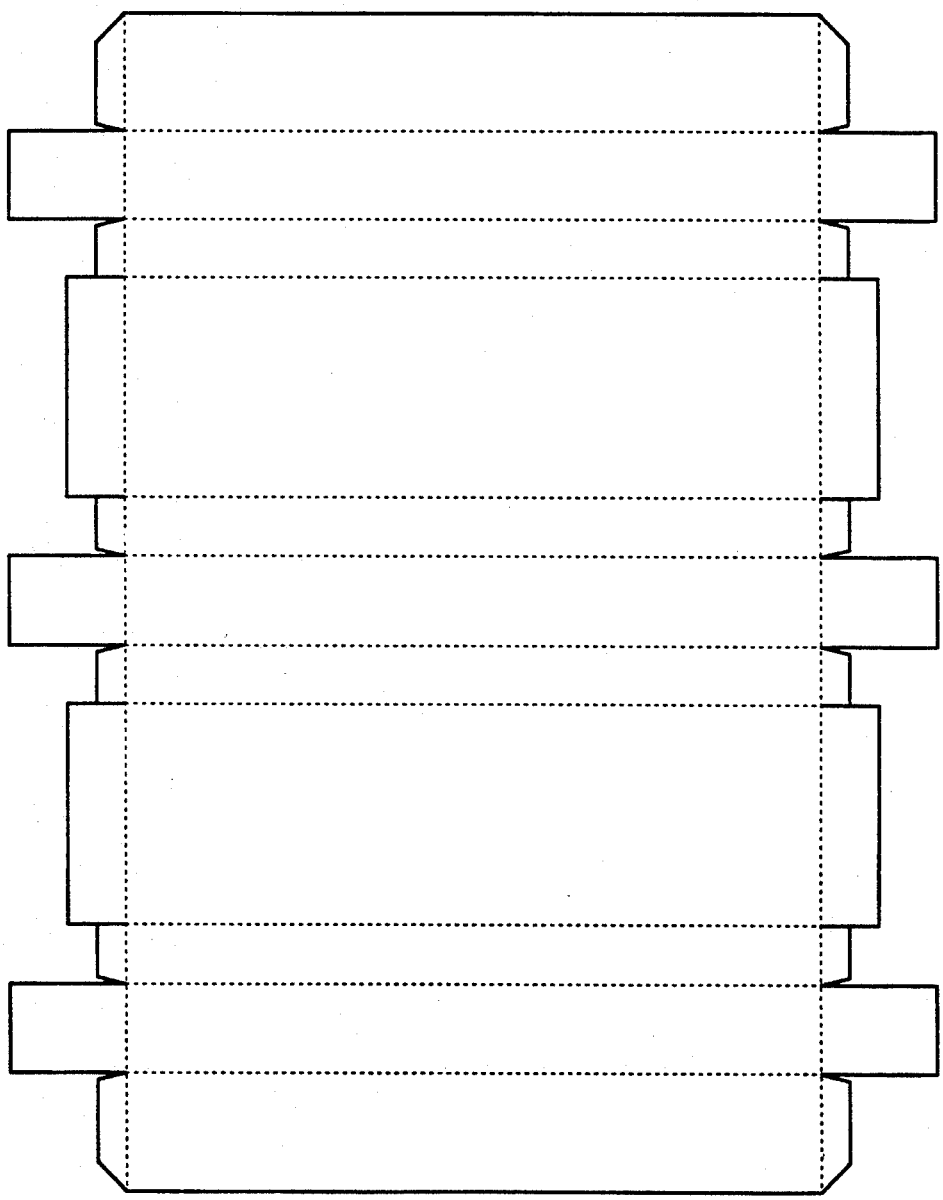
FIG. 3B shows a plan diagram of the lower sheet used in the FIG. 3A configuration.

FIG. 3A shows a version of the FIG. 1A variation in which the upper facing sheet (302) has tabs (304) which fold down onto the edge of the flaps (306) which fold up onto the edge of the central core (100) and runner blocks (104). The upper facing sheet (302) may be of corrugate or paper or other suitable material. Corrugate is used for the upper facing sheet (302) if strength is the ultimate desired use parameter and paper may be used if the cost of the pallet is of great importance. As with the FIG. 1A variation, the pallet has honeycomb or laminated corrugate runner blocks (104) which may be glued to the central core through optional glue sheets (110).

Again, the upper sheet (304) is configured so that it may be folded over the edge of the honeycomb core (100) and overlapped onto and fastened to the lower sheet (306). If the upper facing sheet (304) is corrugate, the flutes in that sheet are preferably not parallel to the corrugated flutes in the lower sheet (306). This feature, in addition to the provision of the tabs adhesively fastened to their respective adjacent sheets will provide additional strength to the pallet cargo support platform.

Figure 4A:
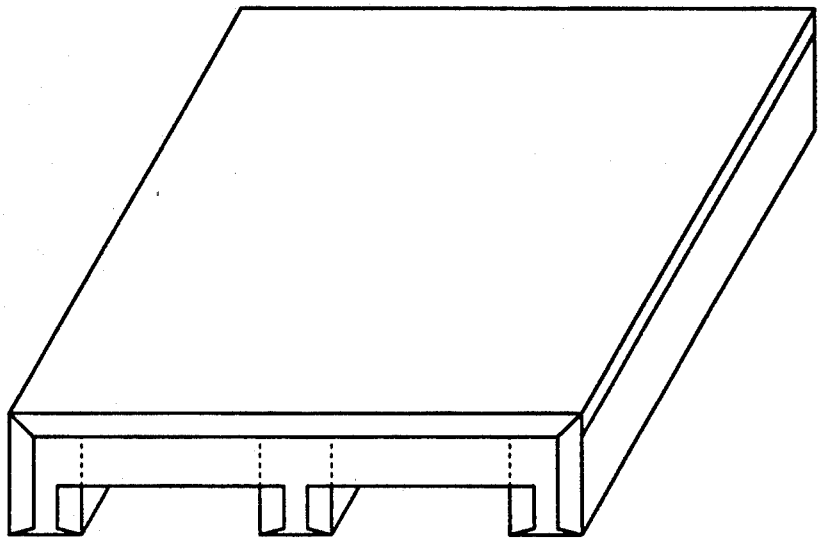
FIGS. 4A and 4B are, respectively, top and bottom perspective views of the inventive pallet.
Figure 4B:
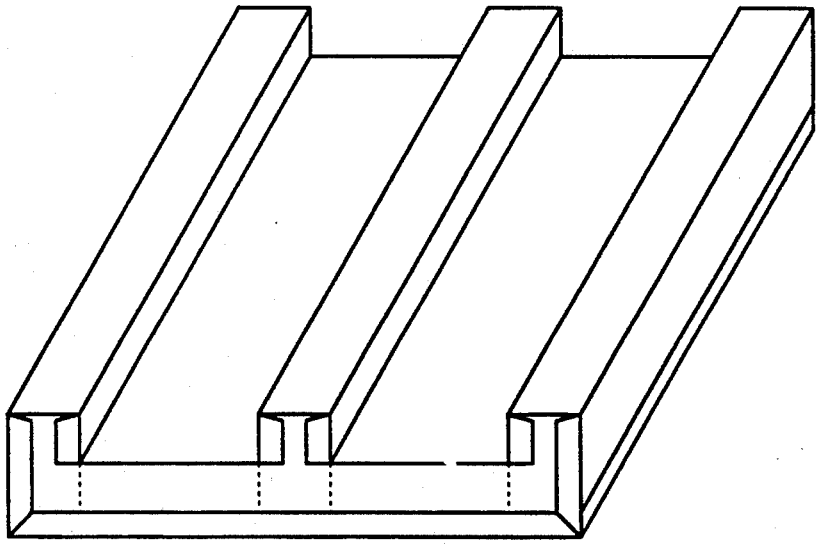

Each of these embodiments is a design known as a two-way entry pallet. FIGS. 4A and 4B are, respectively, top and bottom perspective views of the inventive pallet. The wide slots between the runners on the underside of the cargo deck permit entry of forklift or hand truck tines from either of opposite ends.

This invention is not limited to the basic variation shown in the Figures. Additional sheets of corrugated material may be added to the upper and lower faces of the combination shown in that Figure if additional strength is needed for some particular purpose. Addition of a sheet on the upper (or load-bearing face) is preferable to enhance the impact resistance of the pallet deck. The pallet may be coated with a material which will harden or waterproof or dustproof the pallet. These materials may be chosen to meet whatever criteria are appropriate for the pallet use. For instance, if used in a humid atmosphere or used outside or are moved between refrigerated and non-refrigerated areas, waterproofing is desirable. Known water-based and oil-based materials may be applied as needed.

Additionally, the cargo face of the deck may be covered with or coated with a suitable material to prevent slippage of the cargo.

When the pallet of this invention is used in conjunction with roller conveyer systems, a hard paperboard may be glued to the bottom of the runners. The paperboard is typically one-fourth to one-half inch in thickness and made form thin sheets of paper glued and compressed together to give a hard surface to the bottom of the runners. The hard surface prevents the bottom of the corrugate trays from depressing around the conveyer roller and thereby preventing the load-bearing pallet form rolling easily down the conveyer. The hard paperboard provides adequate hardness for reducing the compressibility of the runner bottom and therefore reduces the drag on the pallet.

It should be apparent that the number of runners is not a critical aspect of the inventive pallet. Similarly, the size and aspect ratios of the pallet described here are not important. This invention includes pallets using a variety of sizes and number of runners.

The invention has been described by description and by example. The examples are just examples and are not to be used to limit the scope of the invention in any way. Additionally, one having ordinary skill in this art will recognize variations and equivalents within the invention as described which will not necessarily be within the scope of the appended claims.

I claim as my invention:

1. A pallet comprising:

a deck of a honeycomb core having an upper face, lower face, and edge;

an upper facing sheet adherent to the upper face of the honeycomb core deck, multiple runner blocks each having bottom and side surfaces, and said runner blocks being separated from each other and adhesively mounted to the lower face of the honeycomb core deck and covering at least a portion of the lower face, a single lower facing sheet comprising a corrugated sheet having flutes therein and adherent respectively to the bottom surfaces of each of the multiple runner blocks and extending upwardly from said runner block bottom to cover and adhere to the side surfaces and the lower face of the honeycomb core deck.

2. The pallet of claim 1 where the composition of one or more of the honeycomb core, upper and lower facing sheets, upper and lower corrugates, and upper and lower sheets is selected from paper, MYLAR, polyethylene, polypropylene (clear or fibrous paper product).

3. The pallet of claim 2 where the composition of one or more of the honeycomb core, upper and lower facing sheets, upper and lower corrugates, and upper and lower sheets is selected from paper.

4. The pallet of claim 1 in which the upper facing sheet is paper.

5. The pallet of claim 1 in which the upper facing sheet is corrugate having flutes therein.

6. The pallet of claim 5 in which the flutes in the upper facing are not parallel to the flutes in the lower facing sheet.

7. The pallet of claim 1 in which at least one of the upper facing sheet and lower facing sheet are folded over and adherent to the edge of the honeycomb core and to the other facing sheet.

8. The pallet of claim 1 where a substantial portion of cells within the honeycomb core are sealed.

9. The pallet of claim 1 where additional corrugate sheets are adherent to the upper face of the honeycomb core deck.

10. The pallet of claim 1 comprising two or more runners.

11. The pallet of claim 10 where the runners comprise a honeycomb runner core.

12. The pallet of claim 8 where the runners comprise a laminate corrugate core.

13. A paper pallet comprising:

a deck of an expanded paper honeycomb core having an upper face, lower face, and edge;

an upper facing sheet of paper sheet adherent to the upper face of the honeycomb core;

multiple honeycomb runner blocks each having bottom and side surfaces, and said honeycomb runner blocks being separated from each other and adhesively mounted to the lower face of the honeycomb core deck and covering at least a portion of the lower face, a single lower facing sheet comprising a corrugated sheet having flutes therein and adherent respectively to the bottom surfaces of each of the multiple runner blocks and extending upwardly from said runner block bottom to cover and adhere to the side surfaces and the lower face of the honeycomb core deck.

14. The pallet of claim 13 where a substantial portion of cells within the honeycomb core are sealed.

15. The pallet of claim 13 comprising two or more runners adhesively attached to the lower face of the deck.

16. The pallet of claim 15 in which the runners are adhesively attached to the deck through glue sheets.

* * * * *